US005454417A

United States Patent [19]

Rosenstock

[11] Patent Number: 5,454,417

[45] Date of Patent: Oct. 3, 1995

[54] METHOD FOR CASTING STEELS IN ARCUATE CONTINUOUS CASTING INSTALLATIONS

[75] Inventor: Hans-Georg Rosenstock, Püttlingen, Germany

[73] Assignee: IBVT Ingenieurbüro f. Verfahrenstechnik GmbH, Germany

[21] Appl. No.: 311,908

[22] Filed: Sep. 26, 1994

Related U.S. Application Data

[63] Continuation of Ser. No. 40,555, Mar. 31, 1993, abandoned.

[30] Foreign Application Priority Data

Mar. 31, 1992 [DE] Germany ..... 42 10 495.5

[51] Int. Cl.[6] ..... B22D 11/22

[52] U.S. Cl. ..... 164/455; 164/414; 164/154.7

[58] Field of Search ..... 164/413, 414, 164/454, 455, 452, 154.7

[56] References Cited

U.S. PATENT DOCUMENTS

| | | | |
|---|---|---|---|
| 3,358,743 | 12/1967 | Adams | 164/413 |
| 4,317,482 | 3/1982 | Wolf | 164/454 |
| 4,588,020 | 5/1986 | Waltl et al. | 164/454 |
| 4,938,045 | 7/1990 | Rosenstock et al. . | |

FOREIGN PATENT DOCUMENTS

| | | | |
|---|---|---|---|
| 289313 | 4/1971 | Austria . | |
| 0036342 | 9/1981 | European Pat. Off. . | |
| 0116030 | 6/1984 | European Pat. Off. . | |
| 57-41868 | 3/1982 | Japan | 164/454 |
| 57-88958 | 6/1982 | Japan | 164/454 |
| 53-188464 | 8/1988 | Japan | 164/454 |
| 53-220960 | 9/1988 | Japan | 164/454 |
| 2280952 | 11/1990 | Japan | 164/454 |
| 3174962 | 7/1991 | Japan | 164/454 |

OTHER PUBLICATIONS

Hans G. Baumann, "Stahlstrang–Giessanlagen", Verlag Stahleisen M.B.H., Dusseldorf, Germany, pp. 86–93 (1976).

Y. Lee et al., "Start–up and Initial Operational Experience of the Stainless Steel Caster at Posco", Proceeding of the 5th International Continuous Casting Conference, pp. 7/2–7/10 (Jun. 18–20, 1990).

*Primary Examiner*—Kuang Y. Lin

*Attorney, Agent, or Firm*—Henry M. Feiereisen

[57] ABSTRACT

The method relates to a method for casting steels on arcuate continuous casting installations, a steel melt being passed through a water-cooled chill mold from which a steel product emerges which has solidified at the surface and is cooled by the action of coolants for the further solidification, deflected circularly over supporting rollers, and subsequently bent from the arc by means of multi-point bending equipment back into the horizontal. The force for straightening the arc-shaped steel product is calculated from the high-temperature properties of the steel determined from high-temperature tensile tests and from the temperature profiles of the steel product calculated from surface temperatures. By a theoretical-actual comparison of values of the calculated straightening force and the actually determined straightening force, the casting conditions and the cooling are controlled so that the steel product is treated as gently as possible during the straightening, whereby surface fissures can be largely excluded.

4 Claims, 4 Drawing Sheets

METHOD FOR CASTING STEELS IN ARCUATE CONTINUOUS CASTING INSTALLATIONS

This is a continuation of application Ser. No. 08/040,555, filed Mar. 31, 1993, now abandoned.

This invention relates to a method for casting steels in arcuate continuous casting installations. More specifically, this invention relates to such a method wherein the steel melt is passed through a water-cooled chill mold, from which a steel strand or billet, solidified at the surface, emerges and is cooled by the action of coolants for further solidification, deflected circularly over supporting rollers, and subsequently bent from the arc by means of multi-point bending equipment back to horizontal.

Highly alloyed steels, such as austenitic or ferritic chromium-nickel, nickel-chromium or 13% chromium steel, to which molybdenum, vanadium, tungsten, silicon or aluminum are added as further alloying components, depending on their intended use and the stresses to which they are subjected, are used as stainless, acid-resistant, heat-resistant or scaling resistant steels and tool-steels. Such steels solidify without transformation. Depending on the chemical composition, carbides and other phases segregate during the solidification. The carbides and other phases differ appreciably metallurgically in the microstructure of the steel alloy in their composition from the basic matrix and have a disadvantageous effect on the tenacity and deformability. Stresses, which arise during solidification, cooling and hot forming, particularly during the straightening of the steels, may lead to tears between the boundary surfaces of the crystals. For this reason, these steels are susceptible to surface fissures and, despite appreciable efforts to limit stress peaks during cooling and straightening, can only be cast in arcuate continuous casting installations with difficulties. These steels, therefore, when produced by continuous casting, are cast primarily on vertical or horizontal continuous casting installations. Both types of installations are operated by methods which have been optimized with respect to the solidification of the steel without fissure formation at the billet surface, and which manage without the straightening of the billets that is required for arcuate installations. However, such installations have only a limited capacity in tons per hour as well as other disadvantages.

On the other hand, vertical continuous casting installations for larger dimensions and outputs would require uneconomically high investment and, because of the small quantities produced in tons per month, would not have sufficient utilization for this range of steel types. Therefore, on the basis of lot-size considerations, highly alloyed steels are still cast in many cases as forging grade ingots or ingots suitable for rolling. The production of blocks and their processing for use in the next production steps and their shaping and forming are expensive and burden the finished products with high production costs.

OBJECTS OF THE INVENTION

It is therefore an object of the invention to provide a method which permits substantially defect-free production of highly alloyed steels on continuous casting installations, the method being usable with all types of steel and lot sizes which come up in the steel area, wherein the process can be controlled to ensure that the steel matrix can absorb the stresses that normally occur and that surface fissures are avoided.

SUMMARY OF THE INVENTION

Pursuant to the invention, this objective is accomplished by determining, in the region of the multi-point bending equipment, the temperatures over the cross-section of the billet and, taking into consideration the high-temperature material properties determined from high temperature tensile tests in the form of stress-strain curves, calculating the straightening force for the minimum deformation required in order to bend the steel billet in the multi-point bending equipment from an arc back into the horizontal.

In accordance with the preferred embodiment of the invention, the theoretical value is compared with the actual value of the straightening force and, in the event that the computed limiting value of the straightening force is exceeded, the billet temperature in the multi-point bending equipment is increased or decreased by increasing or decreasing the secondary cooling within the scope of its control parameters and further by increasing or decreasing the casting rate.

The invention permits plain steel grades as well as fissure-sensitive, highly alloyed steels to be produced substantially defect-free and inexpensively in arcuate continuous casting installations, which have proven to be successful for the production of special steels.

THE DRAWINGS

DETAILED DESCRIPTION

The steel industry has moved from ingot casting to continuous casting in order to save energy, operating and investment costs, and to improve product quality. Despite refined process controls for continuous casting, a defect-free production is not yet reliably assured for a series of steels, particularly highly alloyed steels.

Pursuant to the invention, depending on the type of steel, the format to be cast, and the casting rate or billet cooling, are carried out when straightening the arc-shaped steel billet produced on an arcuate continuous casting installation is gently straightened in multi-point bending equipment, so as to avoid the formation of surface fissures in the billets. According to the invention, the force for straightening the steel billet is calculated so that the stresses which arise during the straightening are so limited that they can be absorbed by the steel matrix without separations. Known high-temperature tensile tests for determining high-temperature strength and tenacity properties of the steels can be recorded as stress strain curves to provide information concerning the force and work required by the shaping and converting equipment as well as the maximum deformation possible that will guarantee sufficient transformation for straightening and will not damage the material.

Figure 1:
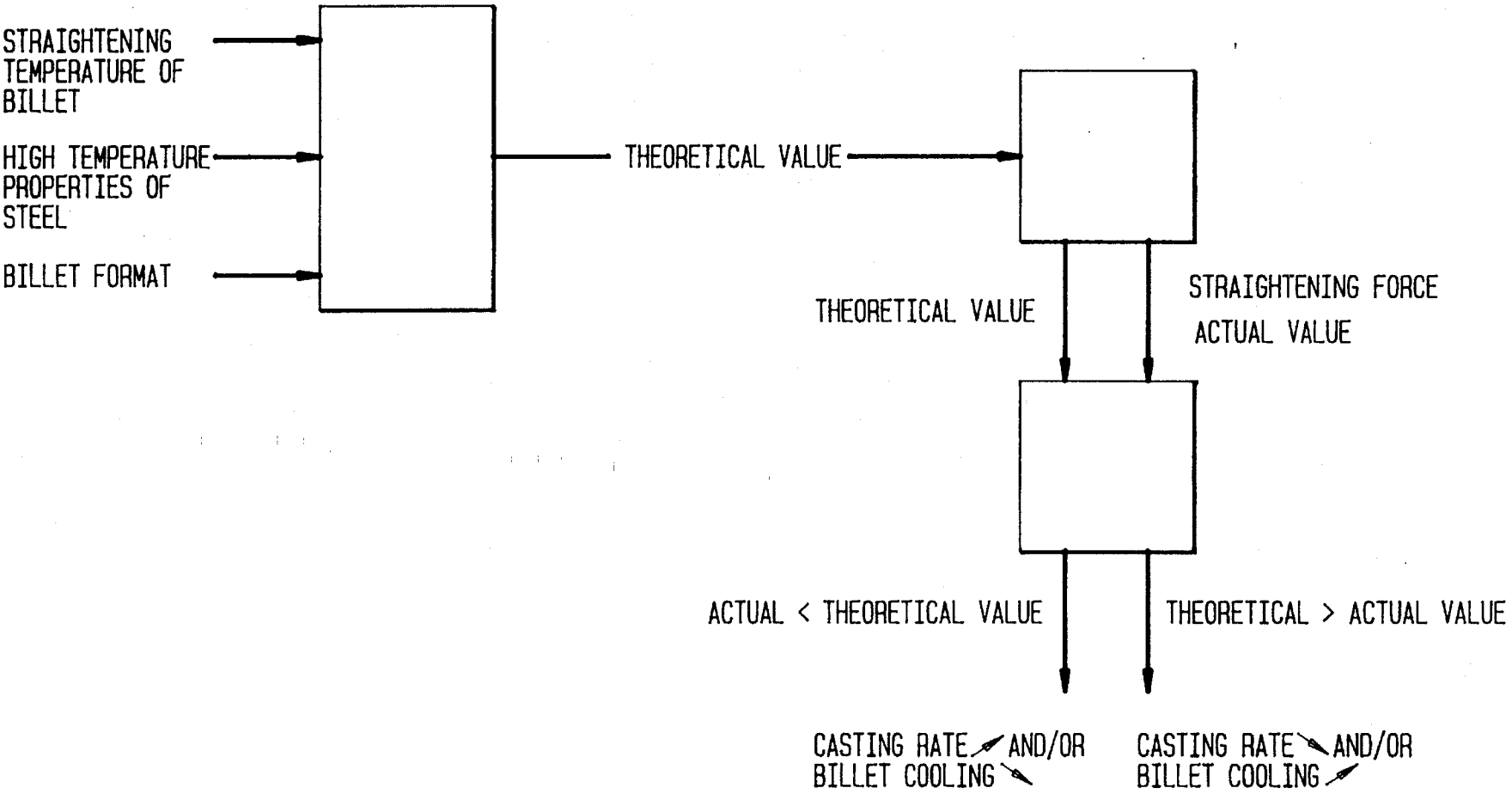
FIG. 1 is a flow chart showing the process steps of the invention.

The high-temperature material properties obtained in this manner are assigned to the billet temperatures, which are determined pursuant to the invention over the cross-section of the billet in the area of the straightening point, for example, by measuring the surface temperature of the billet and calculating from this the temperature profile over the cross-section of the billet. From this information and taking into consideration the casting conditions and the billet format, the straightening force required to bend the steel billet from the arc back to horizontal is calculated. In FIG. 1, a block diagram is shown, from which it can be inferred how the high-temperature properties of a steel can be used to determine the required straightening force and straightening work, which can be affected by the straightening temperatures and thus controlled by the casting conditions and the billet cooling.

Art advantageous feature of the preferred embodiment of the invention provides for a comparison of the theoretical and actual values of the straightening force. The casting rate and/or the billet cooling may be controlled depending on this comparison, as is also shown in the Figure. If the straightening force required exceeds the calculated limiting value for the necessary deformation effort, the straightening temperature can be increased correspondingly by increasing the casting rate and/or changing the billet cooling. In that way, the straightening force can be lowered and adapted to the limiting value derived from the material properties.

On the other hand, if the required straightening force is not attained from the theoretical-actual value comparison, the casting rate is decreased and/or the billet cooling changed appropriately. With that, the straightening temperature is lowered and the force applied increased until a minimum deformation required for achieving a straight billet is attained.

An extension in length of 0.4% as a result of the deformation should be obtained; otherwise, the degree of straightening necessary has not been obtained during the straightening process. Deformation to values of extension less than 0.4% are not technically significant and should not be relied upon to provide meaningful results.

The invention is not limited to the straightening of cast steel billets which are solidified completely in the bending direction. The invention can also be used for straightening partially solidified billets which have a solidified edge zone and a liquid core region. In this case, the strength of the solidified edge zone in the region of the straightening point is determined by the method described and used for the calculation of the required straightening force or work. The straightening of partially solidified steel billets requires less straightening deformation than that of completely solidified billets, so that, on the whole, the deformation can take place under less stress. When straightening highly heat resistant steels, these more gentle conditions also have an advantageous effect on the various parts of the multi-point bending equipment, which are subjected to lower stresses.

The design and control of the continuous casting installation must take these requirements into account. It must therefore be possible to adjust the casting rates and control the billet cooling as a function of the type of steel and of the format that is to be cast. Furthermore, it is necessary to see to it that the solidification behavior, the resulting stress conditions and the dissipation of heat can be matched to one another and controlled. With this control, the steel billets are treated in the most gentle manner conceivable, so that surface fissures can be substantially avoided.

To determine the straightening force which must be transferred in the region of the multi-point bending equipment to the steel billet, there is advantageously available the method described in European publication 0 315 043 for measuring the rolling force on rolling mill rollers. That method compares the force actually present with the maximum permissible force which is a feature of the invention.

Figure 2:
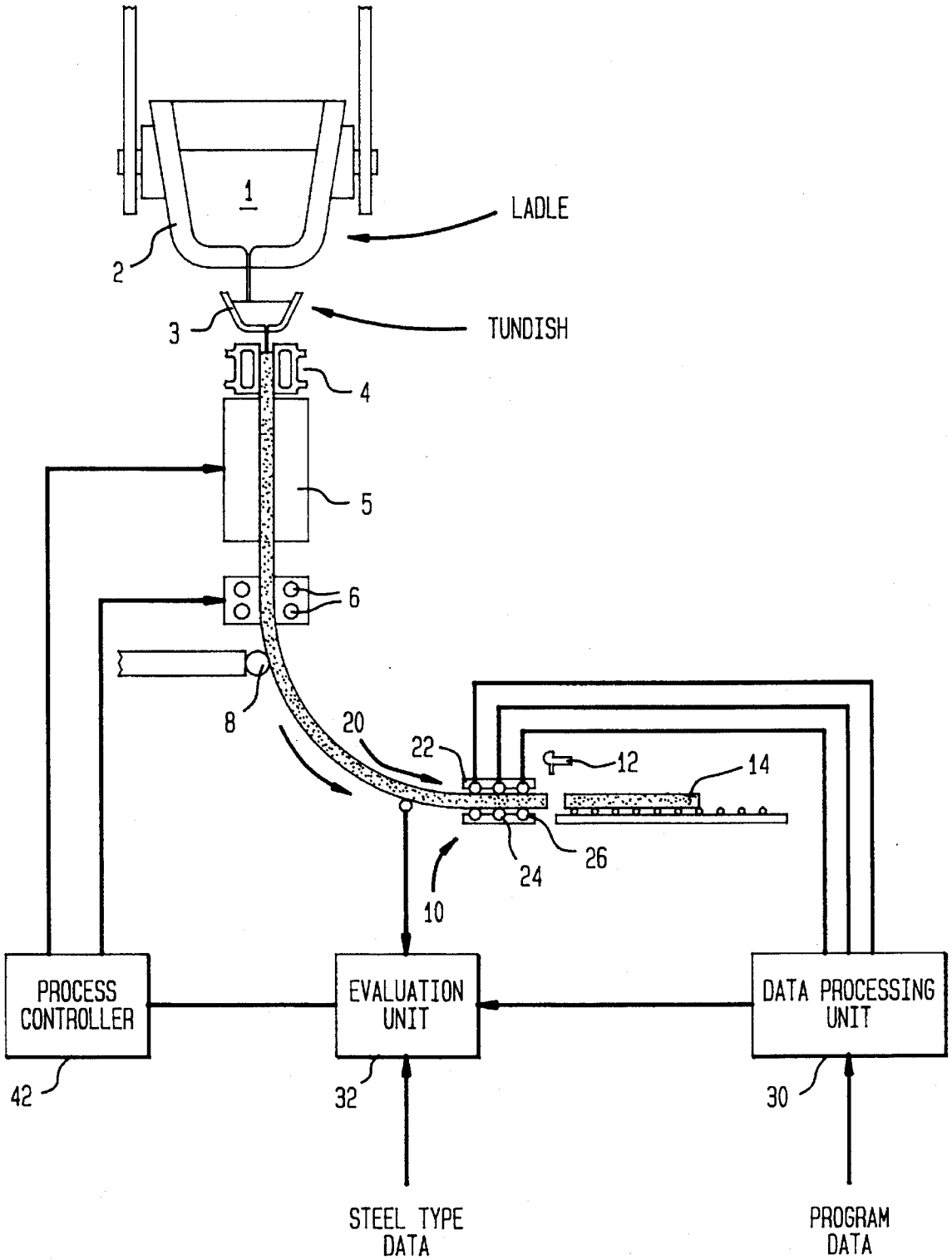
FIG. 2 is a schematic illustration of an arcuate continuous casting process in accordance with the invention.

In FIG. 2, a schematically drawn casting installation according to the invention is shown. Molten steel 1 is brought in a series of successive ladles 2 and poured via a tundish 3 into a continuous casting mold 4 of known type, in which the steel at the outer walls of the mold solidifies to form a hot steel strand. Immediately below the mold 4 is a cooling jacket 5 in which water is sprayed onto the exterior of the strand to cool it further. The interior of the strand remains molten and gradually solidifies as the strand moves downward under the effect of pull from pairs of opposed driven rollers 6.

Below the driven rollers 6 the strand is deformed sideways by a roller 8, causing the strand to deform into an arcuate shape. As the strand moves slowly down it becomes cooler and stiffer. It then passes into a multi-point bending unit 10 which straightens the strand out. Straight lengths of strand are then successively chopped off by a flame torch 12 or the like to form individual blocks of steel 14 for subsequent rolling.

As the strand is bent back by the multi-point bending unit 10, its surfaces are stretched at 20. This can lead to the formation of fissures and other surface defects adversely affecting the quality of the steel produced.

According to the invention, the straightening force exerted by the multi-point bending unit 10 is monitored and used to control the overall operation of the installation.

For any given installation, the vigor with which the bent strand can be flattened without crack formation on its surfaces will depend on how fast the strand is being driven through the multi-point straightening unit, and on how hot the strand is at that point. The strand needs the optimum transformation temperature to make it easier to bend back flat.

The colder the strand is, the greater the upward force exerted by the strand on the (in the example illustrated) three rollers 22, 24, 26 of the unit.

In accordance with the invention, the upwardly directed force on each of the three rollers 22, 24 and 26 is measured, e.g., using the system described in U.S. Pat. No. 4,938,045. These measurements are fed to a data processing unit 30 which has been programmed with data enabling it to calculate an actual value for the straightening force being applied to the strand.

This actual value is then passed to an evaluation unit 32. Evaluation unit 32 has a further input derived from a temperature sensing unit 40 which feeds data about the strand temperature just upstream of the multi-point bending unit 10 into the evaluation unit 32.

Evaluation unit 32 is programmed with data corresponding to the type of steel being cast, particularly its dynamic physical behavior at the range of temperatures involved. From this data, and taking into account other factors, such as the shape of the strand, the geometry of the path it is constrained to follow, it speed and its temperature, it is possible to calculate a maximum safe straightening force. If the straightening force were greater, it would imply the strand was likely to develop cracks in its upper surface.

Evaluation unit 32 is thus able to carry out a comparison between the theoretical maximum safe straightening force and the actual force applied. As a result of that comparison, control signals may be sent to a controller 40 which controls via known means the amount of cooling effected in cooling jacket 5 and the casting speed controlled by driver rollers 6.

The effect of varying casting speed on the straightening force is far less than that of varying temperature just upstream of the multi-point casting unit 10. However, the casting speed and temperature at sensing unit 40 are related: the lower the casting speed, the cooler the strand by the time it reaches unit 40.

Accordingly, the evaluation unit 32 is programmed to send signals to the process controller 42 in accordance with the following rules:

If the actual value of the straightening force exceeds the calculated desired value, the speed of casting is increased and/or the amount of cooling decreased. Although the former change initially increases the straightening force applied, as soon as the temperature of the strand just upstream of unit 10 has increased adequately, the force drops.

If the actual value of the straightening force is less than the theoretical value, the speed of casting is decreased and/or the cooling of the strand increased, both leading to a drop in the temperature of the strand just upstream of unit 10 and an increase of the straightening force towards the maximum safe value.

Although the previous discussion refers to a steel strand or billet emerging from the water-cooled chill mold, the present invention is intended to also cover a steel bloom, a steel cog bloom, a steel roughed slab, a steel ingot, a pre-strip (i.e., an intermediate product for a cold strip mill) or any other type of continuously cast steel product that emerges from such a water-cooled chill mold.

Figure 3:
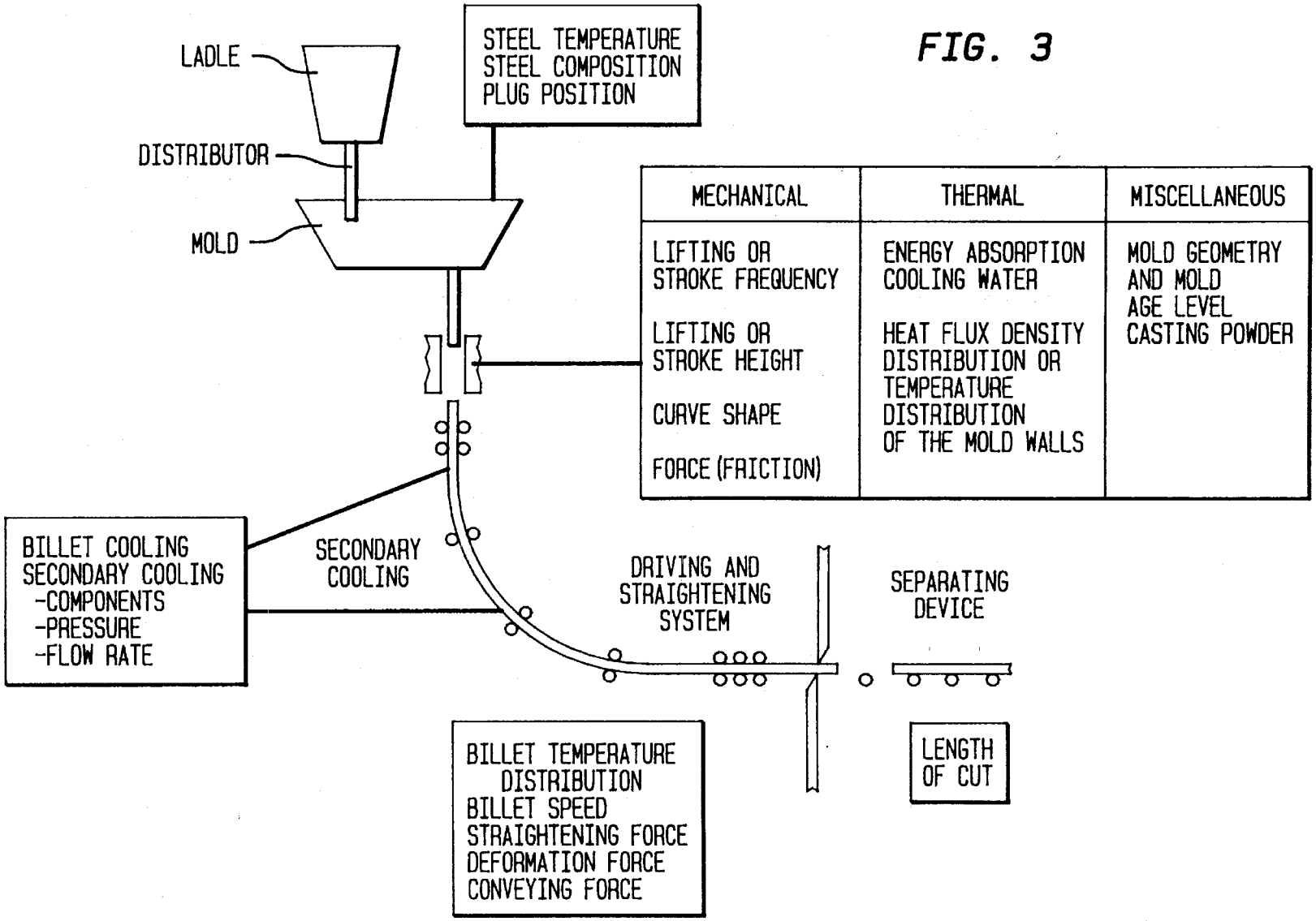
FIGS. 3 and 4 are schematic control diagrams for controlling the arcuate continuous casting process in accordance with the invention.
Figure 4:
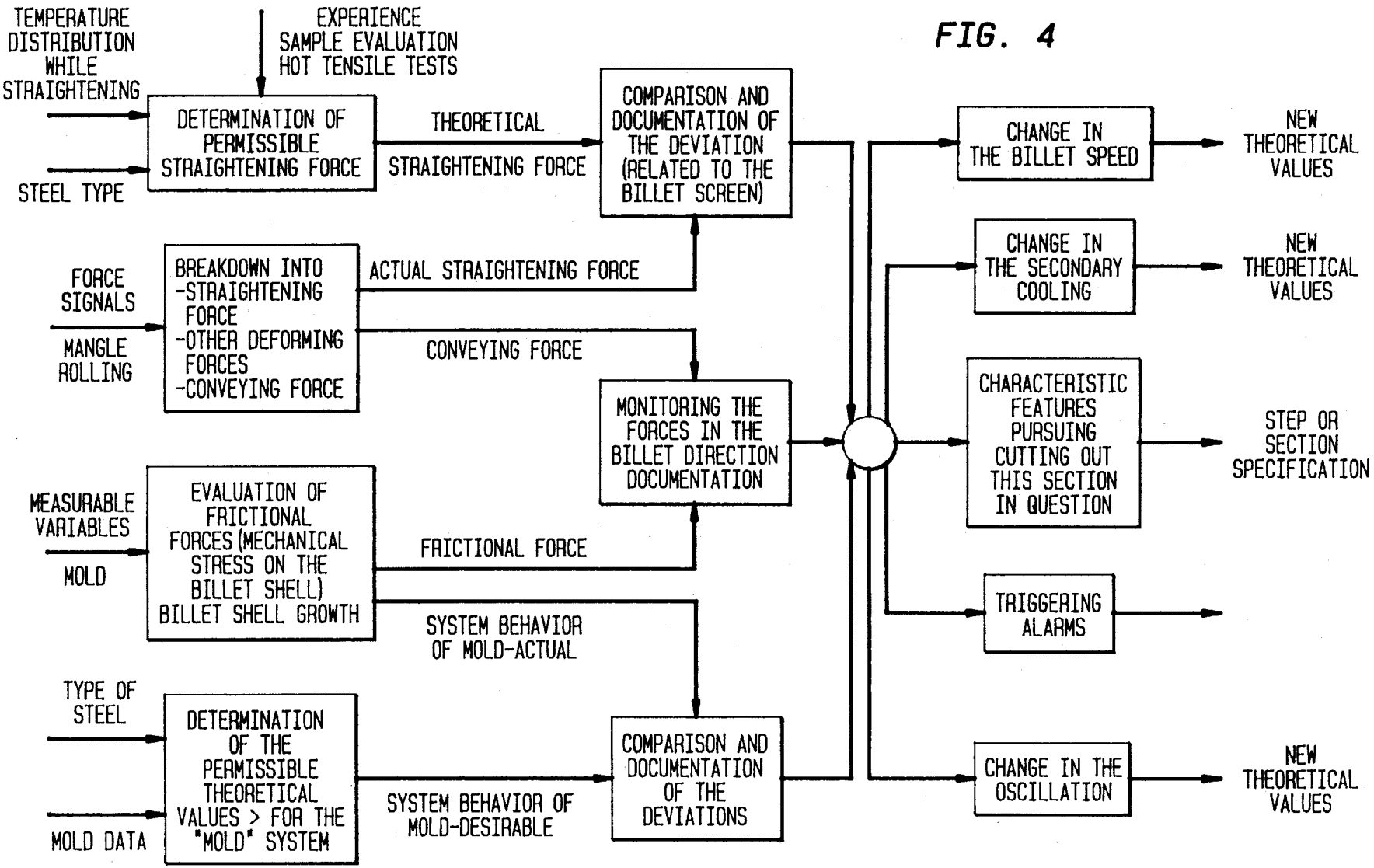

FIGS. 3 and 4 show control diagrams for controlling an arcuate continuous casting process in a continuous casting plant. Such a continuous casting plant casts at a metallurgically desirable casting rate and attains at least a 0.4% extension in length of the cast product from the deformation during straightening. This is ensured by means of the straightening force, which was determined mathematically. The continuously cast product lies flat on the delivery bed. The temperature measurement shows that the same extension is attained mathematically with a lesser straightening force; the straightening force thus is reduced.

If the product temperature falls in the course of the casting, the straightening force must be increased or the cooling decreased. If the casting rate is increased, in order to be able to work with the smallest possible straightening force, the computational model takes into consideration the additional work of deformation arising out of the more rapid straightening reshaping.

If steels are cast within a deformation temperature interval, an upper temperature may not be exceeded; otherwise, metallic phases melt. Also, a lower temperature must not be exceeded; otherwise fissures are formed during straightening. The parameters of casting rate and cooling, as well as the resulting straightening force must be adapted correspondingly. Temperature limits may be set to prevent the temperature of the cast from exceeding those limits.

What is claimed is:

1. A method of casting steels on arcuate continuous casting installations, comprising the steps of:

passing a steel melt through a water-cooled chill mold to form a steel product which solidifies at the surface;

cooling the steel product for further solidification;

laterally deflecting the steel product by a curved arrangement of guiding rollers;

determining a temperature over the cross-section of the steel product in the area of a multi-point bending arrangement to provide a temperature signal;

calculating a desired straightening force for minimum deformation required to bend the deflected steel product in the multi-point bending arrangement into a horizontal path through determination from empirical stress-strain curves commensurate with high-temperature material properties for the steel product in dependence on the measured temperature signal; and regulating cooling condition of the steel product based on the calculated desired straightening force.

2. The method of claim 1, further comprising carrying out a comparison of the desired straightening force with the actual straightening force and, in the event that the computed limiting value of the straightening force is exceeded, raising the product temperature in the multi-point bending equipment (a) by decreasing the secondary cooling within the scope of its control parameters and (b) by increasing the casting rate as a control parameter of the product temperature.

3. Apparatus for casting steels on arcuate continuous casting installations, comprising:

a water-cooled mold for producing a steel product;

first roller means for laterally deflecting the steel product along a curved path; and second roller means arranged downstream of said first roller means for bending the steel product into a horizontal path;

measuring means for determining a temperature over the cross-section of the steel product in the area of said second roller means to provide a temperature signal;

evaluation means receiving the temperature signal from said measuring means for calculating a desired straightening force for minimum deformation required to bend the deflected steel product by said second roller means into the horizontal path through determination from empirical stress-strain curves commensurate with high-temperature material properties for the steel product in dependence on the measured temperature signal and process controlling means for adjusting cooling condition of the steel product in response to the calculated value from said evaluation means.

4. The apparatus of claim 3, wherein said evaluation means carries out a comparison of the desired straightening force with the actual straightening force, and further comprising means for raising the product temperature in the area of said second roller means in response to the computed limiting value of the straightening force being exceeded (a) by decreasing the secondary cooling within the scope of its control parameters and (b) by increasing the casting rate as a control parameter of the product temperature.

* * * * *